United States Patent [19]
Knieper et al.
[11] Patent Number: 4,461,722
[45] Date of Patent: Jul. 24, 1984

[54] METHOD OF SOLIDIFYING WASTE MATERIALS, SUCH AS RADIOACTIVE OR TOXIC MATERIALS, CONTAINED IN AQUEOUS SOLUTIONS

[75] Inventors: Josef Knieper, Setterich; Heinz Printz, Rödingen; Karl May, Julich, all of Fed. Rep. of Germany

[73] Assignee: Kernforschungsanlage Jülich Gesellschaft mit beschränkter Haftung, Jülich, Fed. Rep. of Germany

[21] Appl. No.: 365,305

[22] Filed: Apr. 5, 1982

Related U.S. Application Data

[63] Continuation of Ser. No. 134,752, Mar. 28, 1980, abandoned, and a continuation of Ser. No. 841,712, Oct. 13, 1977, abandoned, which is a continuation-in-part of Ser. No. 701,078, Jun. 30, 1976, abandoned.

[30] Foreign Application Priority Data

Jul. 11, 1975 [DE] Fed. Rep. of Germany ..... 2531056

[51] Int. Cl.[3] ..... G21F 9/16
[52] U.S. Cl. ..... 252/628; 106/77
[58] Field of Search ..... 106/77, 74; 252/628

[56] References Cited

U.S. PATENT DOCUMENTS

| | | | |
|---|---|---|---|
| 3,837,872 | 9/1974 | Conner | 106/74 |
| 3,988,258 | 10/1976 | Curtiss et al. | 252/628 |

FOREIGN PATENT DOCUMENTS

| | | | |
|---|---|---|---|
| 1109279 | 6/1961 | Fed. Rep. of Germany | 252/628 |
| 2356253 | 5/1975 | Fed. Rep. of Germany | 252/628 |
| 938211 | 10/1963 | United Kingdom | 252/628 |

OTHER PUBLICATIONS

Aikawa et al., *Chem. Abstracts,* 82, (1975), 130869u.
Aikawa et al, *Chem. Abstracts,* 74, (1971), 59901a.
Rudolph, *Chem. Abstracts,* 83, (1975), 151902k.
Babushkin et al., *Chem. Abstracts,* 77, (1972), 92338g.

*Primary Examiner*—Deborah L. Kyle
*Attorney, Agent, or Firm*—Becker & Becker, Inc.

[57] ABSTRACT

A method of solidifying waste materials, such as radioactive or toxic materials, which are contained in aqueous solutions. To accomplish this solidification, an inorganic, non-metallic binding agent such as gypsum is intermixed with the aqueous solution and a substance such as pumice or ceramic tile which promotes the intermixing of the binding agent and the aqueous solution.

6 Claims, No Drawings to 1.8 kg/dm$^3$; the mixing proportion is about 1 kg gypsum to 100 to 500 ml water glass. To the thus formed, partially granular, partially pulverous mixture there is added the aqueous solution which contains one of the mineral acids, such as HF, $H_2SO_4$, $HClO_4$, HCl, or $HNO_3$, or one of the alkalies, such as KOH, NaOH, $NH_3$, $Ca(OH)_2$, up to 40% by weight, or water soluble organic compounds up to a content of 50% by weight; the mixing proportion is about 1 kg of the gypsum and water glass mixture to 500 ml aqueous solution. Sodium as well as potassium water glass ($Me_2SiO_3$, $Me_2SiO_4$, $Me_2SiO_5$) may be used. With this alternative solution also no disturbing gas or heat develops if strongly acidic or alkaline aqueous solutions are being solidified.

When intermixing gypsum and water glass, it is expedient to add water glass by batches while stirring the added water glass into the gypsum. The thus formed, partially granular, partially pulverous mixture, which may be stored for about a week, for the solidification of an aqueous solution is placed in a container intended for the final storage, and the aqueous solution is added. In this connection the advantage is obtained that no mechanical agitation of the mixture is required, so that also by this alternative method according to the present invention a simple and safe solidification of the aqueous solution may be carried out.

EXAMPLE 1

Plaster of Paris or flour of gypsum having a carbon or carbonate content of less than 1% and a crystal water content of between 4.7 and 6.6% was mixed together, while being mechanically agitated, with pumice having an average grain size of about 6 mm diameter; the mixing proportions were about 1:1. 100 kg of this mixture was loaded in a 200 l container, the inside of which was lined with steel plates coated with synthetic resin varnish. Approximately 50 l of a radioactive, strongly nitric or nitrated fluid were subsequently added thereto. No gas formation was evident. Only a small amount of heat was produced. The mixture was set for solidified after about 1 to 2 hours.

EXAMPLE 2

Plaster of Paris or flour of gypsum of the type used in Example 1, while being mechanically agitated, was mixed with sodium silicate having a specific weight of 1.37 kg/dm$^3$ in a mixing proportion of 1 kg to 200 ml. After several seconds a partially granular, partially pulverous mixture resulted. 1 kg. of this mixture was subsequently placed into a 2 liter container of synthetic material, such as polyethylene. To this was added 500 ml of a radioactive, strongly hydrochloric solution. Again no gas formation was evident and only a small amount of heat was produced. This mixture set or solidified in about 1 to 2 hours.

Gypsum or Plaster of Paris is not suitable at all for carrying out the method known from the prior art. Gypsum is not a hydraulic binding means, in other words, a binding means which also hardens under water, but rather is a so-called "air binder" the hardening of which occurs only under access of air. Only hydraulic binding means are provided for in the method disclosed by the prior art; at several locations and in the text of the prior art, further it has been specifically emphasized that only hydraulic binding means are intended for the method of the prior art. Accordingly no unbiased reader can derive the employment of plaster of Paris from the prior art.

The statements in the prior art further impress upon an unbiased reader skilled in the art that with the known method only hydraulic binders are to be used as mixture which harden under water. Under these circumstances an average man skilled in the art who wants to be certain that the mixture also hardens would not under any circumstances utilize a non-hydraulic binder, for example plaster of Paris or in this connection derive the use of plaster of Paris from the method of the prior art. For this reason it is totally unrealistic for any average man skilled in the art to interpret the prior art lines as a suggestion to supply a non-hydraulic binder such a plaster of Paris.

Aside from the utilization of plaster of Paris according to the invention, and aside from the fact that the method of the prior art in contrast to the method of the present invention, it is based on the employment of a pure binder substance and on a mixture of the binder with a granulate, there is stressed that the present invention differs from prior art not only as to its method but also as to purpose. With the known method of the prior art, the concern is primarily to preclude endangering the operating personnel during the mechanical mixing or agitation of the mixture to be solidified. This object has been realized by the present invention, by first intermixing plaster of Paris and the porous solid substance and subsequently adding thereto the aqueous solution. There is apparent from the prior art that no thought was given to the fact pointed out with reference to the printed publication of Amphlett, C. B. Treatment and Disposal of Radioactive Wastes (Pergammon Press, New York, 1961) pp. 1–8 to 898 A56, that radioactive waste solutions conventionally contain acidic, alkaline, or also organic compounds and that during the solidification or acidic solutions, especially also when utilizing the binders mentioned by the prior art, a disturbing gas development and heat development will occur. It is precisely this fact which with the method of Alberti creates the possibility of additionally endangering the operating personnel, keeping in mind that with the prior art method the fluid is introduced from below into the mixture. Since the average man skilled in the art is familiar with the difficulties arising during the solidification of acidic solutions. There is respectfully noted that the average man skilled in the art also for this reason could not be led to the teaching of the present invention on the basis of the method disclosed by the prior art.

Even considering the teaching of additional prior art, it would not be obvious to the average man skilled in the art to use gypsum in order to create a method which is suitable for the solidification of all radioactive solutions, which means also acidic or organic solutions. The experts previously proceeded on the basis that the disturbing gas and heat development occurs also when employing gypsum. It should be noted that in order to arrive at the present invention, inventive steps including quite a number of investigations and tests were necessary in order to find out the additional requirements which must be met when employing gypsum and a porous solid substance, namely that these must not provide more than a carbonate content of 1%. Accordingly, there exists no doubt that applicants have the merit of being the first to have found a method of solidifying nearly all radioactive liquid occurring in practice without endangering the operating personnel; Furthermore, when practicing the solidifying method according to the invention, an end product is obtained which

METHOD OF SOLIDIFYING WASTE MATERIALS, SUCH AS RADIOACTIVE OR TOXIC MATERIALS, CONTAINED IN AQUEOUS SOLUTIONS

This is a continuation application of Ser. No. 134,752, filed Mar. 28, 1980, now abandoned, and Ser. No. 841,712—Kneiper et al filed Oct. 13, 1977, now abandoned, being based on German Patent Application Serial No. P2531056 filed July 11, 1975, as claimed for priority under 35 USC 119, which was a continuation-in-part of co-pending application Ser. No. 701,078—Knieper et al filed June 30, 1976, now abandoned. The present invention relates to a method of solidifying waste materials, such as radioactive or toxic materials, contained in aqueous solutions, according to which an inorganic non-metallic binding agent which solidifies with the addition of water, the aqueous solution and a substance which promotes the intermixing of binding agent and aqueous solution are mixed together.

It is the endeavor of the technical experts in the art to create the possibility of safely handling waste materials, which have no further industrial use, during their transport or storage so as not to endanger the environment. One of the requirements to accomplish this, for instance during the transport or storage of aqueous solutions which contain radioactive materials, consists in treating these solutions prior to their transport or storage so as to convert them into solid end products. However, in this connection it is not sufficient to confine or seal the aqueous solution in permanent containers.

A heretofore known method of solidifying aqueous solutions which contain radioactive materials consists in adding the solutions which result from chemical separations, activation anaylses, extractions, decontamination operations, or also from recovery of fuels, to a mixture of cement and vermiculite, whereby a solidification of the aqueous solution from the reaction with the cement is obtained. However, a drawback of this known method consists in that a troublesome development of gas and heat during the solidification of aqueous, acidic solutions occurs, leading to long delays and, therefore, making the method uneconomical. In addition thereto, during solidification of strongly acidic aqueous solutions, a safe accomplishment of the method can no longer be assured for the operating personnel since, because of the great heat development, bubbling-up and spattering of the solution cannot be avoided. Furthermore, there also exists the possibility of contaminating the environment. A further drawback consists in that the vermiculite contained in the mixture, because of its light weight, is partially carried on the surface of the aqueous solution, resulting in a non-homogeneous end product which does not meet the requirements for the solidification of the aqueous solution.

It is an object of the present invention to provide a method of solidifying aqueous solutions containing radioactive or toxic materials, which makes it possible to produce an end product which contains the waste materials in a homogeneous distribution and can be produced in such a manner as to be safe to the operating personnel.

It is a further object of the present invention to provide a method as set forth in the preceding paragraph which can be carried out even if the aqueous solution to be solidified is strongly acidic or alkaline, without having to make allowance for, or put up with, long delays.

Yet another object of the present invention consists in that the substances necessary for carrying out the method should be as inexpensive as possible.

With these and other objects and advantages in mind, the method according to the present invention is characterized primarily in the aqueous solution, which contains one of the mineral acids, such as HF, $H_2SO_4$, $HClO_4$, HCl or $HNO_3$, or one of the alkalies, such as KOH, NaOH, $NH_3$ or $Ca(OH)_2$, up to 40% by weight, or water soluble organic compounds up to 50% by weight, is mixed with a porous, solid substance having a carbonate content of less than 1%, the substance comprising a ceramic material, pumice, or the like having a granulation from about 2 mm up to an average diameter of about 20 mm. The aqueous solution is also mixed with gypsum having 4.7 to 6.6% water of crystallization and a carbonate content of less than 1%. The mixture ratio of gypsum to porous, solid substance is from 1 to about 0.5 to 3, and the mixture ratio of the aggregate of gypsum and porous, solid substance to aqueous solution is about 0.7 to 1.3 kg to 500 ml.

No disturbing gas or heat development occurs while carrying out the method according to the present invention. Since by using the porous, solid substance, which may be comprised, for example, of ceramic tile chippings having a specific weight between 1.0 and 1.4 $kg/dm^3$, a good inter-mixture of the gypsum with the waste materials contained in the aqueous solution is realized, the waste materials are correspondingly homogeneously distributed in the solid end product.

During mixing, the components of the mixture of gypsum, solid substance, and aqueous solution are expediently mechanically agitated by means of a stirring apparatus, agitator, or the like, and the requisite amounts are added in a sequence adapted or proportional to the requisites of the mixture. In this connection it may be expedient by batches or continuously to add the quantities of gypsum, solid substance, and aqueous solution. In the event that also non-aqueous organic compounds are used, alcohol and water are added to these compounds in such an amount that the mixture contains about 20% non-aqueous organic compound, the thus formed mixture of non-aqueous organic compound, alcohol, and water is then intermixed with an appropriate amount of gypsum and solid substance.

A particularly advantageous specific embodiment of the method according to the present invention consists in first intermixing the gypsum and porous, solid substance and subsequently adding the aqueous solution to the thus formed mixture. This makes it possible to produce a homogeneous end product without necessitating a mechanical agitation of the components which are to be intermixed. Since, in addition, the gypsum and solid substance mixture may be stored for several months in a closed container without becoming unusable, the solidification of aqueous solution is a very simple manner is possible. To do so, it is merely necessary to pour the mixture of gypsum and solid substance into the container intended for the final storage and then to add the aqueous solution.

An alternative solution to the previously stated objects as taught by the method according to the present invention is characterized primarily or first in the substance which promotes the intermixing of binding agent and aqueous solution be so formed that gypsum having a crystal content of about 4.7 to 6.6% and a carbonate content of less than 1% be mixed together with water glass having a specific gravity in the range of from 1.2 glass mixture and the accompanying data of Table 3 was compiled.

TABLE 3

α-Activity release A to air stream from gypsum-pumice and gypsum-water glass specimen*

| gypsum-pumice | | | gypsum-water glass | | |
|---|---|---|---|---|---|
| time lapse [h] after solidification | A × $10^6$ [μCi/min] | temp. [°C.] | time lapse [h] after solidification | A × $10^6$ [μCi/min] | temp. [°C.] |
| 0.33 | 46 | 20 | 0.33 | 18 | 20 |
| 0.67 | 61 | 20 | 0.67 | 25 | 20 |
| 20 | 28 | 20 | 1 | 32 | 20 |
| 45 | 32 | 20 | 4.8 | 68 | 20 |
| 93 | 22 | 20 | 5.2 | 58 | 20 |
| 122 | 18 | 20 | 12 | 40 | 20 |
| 141 | 17 | 20 | 22 | 32 | 20 |
| 192 | 21 | 20 | 113 | 20 | 20 |
| 214 | 20 | 20 | 117 | 18 | 20 |
| 216.5 | 26 | 60 | 122 | 24 | 60 |
| 216.7 | 27 | 60 | 122.3 | 31 | 60 |
| 217.5 | 16 | 80 | 124 | 27 | 80 |
| 217.8 | 14 | 80 | 124.3 | 33 | 80 |
| 218 | 12 | 80 | 124.6 | 28 | 80 |

*Made according to the recipes for solidification of fission products solutions ($HNO_3$ content = 200 g/l solution, γ-activity of specimen ~ 20 μCi. Relative humidity of air 50-60%).

Apparent from table 3 is the fact that the emission rates for both investigated probes or samples are approximately equal and accordingly in both instances are situtated more advantageously than with the mixture on the basis of cement-vermiculite.

The gypsum or plaster here is not simple plaster, but rather plaster or gypsum with a crystal water content of approximately 4.7-6.6% and a carbonate content of 1% as set forth. The crystal water content of "plaster of paris" described by the formula $CaSO_4\frac{1}{2}H_2O$ lies in this range as can be shown by a conversion or calculation. On the other hand, however, it would not be justified to refer to "plaster of paris" since this would represent a restriction as to the crystal water content and such restriction is not believed to be justified for the teaching of the present invention. The specifying of gypsum is being maintained.

No basis in fact prevails for any belief that no surprising improvement exists when compared with the simultaneous mixing of the components particularly when according to a first method step there is first mixing of water glass and gypsum and not until there after is there added the waste solution. By way of mixing of gypsum and water glass, moreover as already set forth previously, there are formed small substantially ball-formed particles which provide a very good capability of taking up waste solution and in this manner make possible production of a homogeneous end product. If in contrast the waste solution were mixed directly with gypsum and water glass, is admixed thereafter, accordingly, there would not be possible to realize a homogeneous distribution of the radioactive materials in the end product since the gypsum hardens very quickly and no mixing of gypsum and water glass would then be possible any more.

Additionally, it is possible according to the foregoing method that the partially powdery partially granular mixture formed from gypsum and water glass can be produced as much as one week prior to the actual solidifying of the waste materials so that for solidification of the waste materials there is necessary only that the waste materials are added onto the already prepared mixture. The procedure of solidification accordingly by way of the present inventive teaching is possible in a very simple and straight forward manner free of danger while a different sequence in the mixing of gypsum, water glass and waste solution either leads to a non-homogeneous end product or makes necessary mechanical stirring during the procedure of the solidification.

In view of possible comment that the prior art has not provided any limit with respect to the type of waste to be treated, reference is made to the aforementioned example according to which during use of cement for the solidification of acid solutions, a solid end product cannot be achieved. Alberti believes he could possibly compensate this thereby that he has solidified the waste solutions directly in the container provided for the end storage. Curtiss in contrast teaches as already mentioned, that prior to the solidification of acid waste solutions, these acid solutions must be neutralized.

The references considered provide basis for concluding that gypsum under influence of acid does not bubble in the same manner as marble. Since the hefty reaction of marble in acids is well known, this states nothing more and nothing less than that gypsum does not show the same hefty reaction. This statement, however, does not set forth as may be erroneously presumed that gypsum does not give off any gaseous foreign products when brought into combination or when combined with acids. There is stressed as already shown that for this purpose it is necessary that the carbonate content in gypsum amounts to less than 1%. No showing or suggestion exists in the publication reference as to this feature of the present invention.

The gypsum to be used has been sufficiently clearly set forth and the teaching of the present invention differs from the cited state of the art.

What is claimed is:

1. A method of solidifying wastes which are in aqueous solution without producing gas and heat, the method comprising the steps of:

(a) first forming a granular mixture having a specific gravity greater than water by combining gypsum with a substance selected from the group consisting of sodium silicate and potassium silicate to form a stable mixture with a long shelf life which is readily available for use, and (b) subsequent to forming the mixture of Step (a), combining the mixture of Step (a) with the aqueous waste solution to form a homogeneous mixture which hardens into a homogeneous solid.

2. The method of claim 1 wherein the aqueous solution is a radioactive solution.

3. The method of claim 1 wherein the solution is an acidic radioactive solution.

4. The method of claim 1, 2 or 3 in which the aqueous solution is mixed with the mixture of Step (a) at a ratio about 500 ml aqueous solution to about 1 kg of the mixture of Step (a).

5. A method of solidifying aqueous solutions of toxic radioactive wastes wherein the method is independent of the pH value of the solutions, the method comprising the steps of: mixing gypsum and sodium silicate to form a solidification medium and thereafter mixing the solidification medium with the aqueous solution and letting the resulting mixture stand for a period of time to form a homogeneous solidified mass.

6. A method of solidifying aqueous, radioactive and toxic waste solutions without the production of gas and heat that might endanger operating personnel wherein contains the waste materials in a homogeneous distribution.

The method of the present invention does not consist merely in the production of a mixture of water glass and gypsum. According to a first step, there is formed a substance aiding in the intermixing of a binder and an aqueous solution. This substance is obtained by using gypsum with water glass and consists primarily of nearly ball-shaped particles. In view of this structure, this mixture is particularly well suitable to absorb fluids as has been proven in practice. This special utilization of water glass cannot be derived from the previously known state of the art.

A viewpoint is believed to be in error if this is taken to mean with the mentioning of gypsum or plaster in connection with a statement "materials which harden by a combination of hydrolysis and hydration reactions upon the addition of water" sets forth that with gypsum or plaster there is involved a hydraulic binder. This statement is not equal in meaning with the statement of whether binding means is hydraulic or non-hydraulic. Entirely aside therefrom that the expert also could not understand the situation in this manner, attention is once again directed to the following:

A hydraulic binding means exists when the binding means hardens also under water.

This is true for example with hydraulic lime, cement, slatwet binder means. If the hardening occurs in contrast only in air, as with gypsum, "Sorel" cement, anhydrous binder, magnesium binder or white lime, accordingly mention is made to refer to non-hydraulic binder means or "air binders". For this reason reference is made to an inorganic non-metallic air binder and the listing of different binding means without selection, is nothing more than an unspecified notation of binding means which basically are to be taken into consideration for solidification of solutions. The type of waste solution for example whether acid or alkaline (base), is not taken into consideration therewith at all. A neutralization of the solution is suggested moreover for example in the event that an acid solution is to be solidified. Accordingly the teaching of the prior art must be considered complex since in practice acid solutions often are encountered. Since waste solutions frequently are encountered in hot cells for example during preparation or irradiated fuel elements and in hot cells every additional method step is to be avoided, the teaching of the prior art in most instances cannot be used in practice. The known method additionally has the disadvantage that the solidified quantity provides a larger volume than the starting quantity.

In comparison, the present invention has the object to create a method which makes possible directly to solidify also strong acid solutions. The end product furthermore is to contain the waste materials additionally in homogeneous distribution. Additionally, the method is to be capable of being carried out without danger for the operating personnel. The present invention accordingly proceeds on the basis of setting of a problem. which is entirely ignored by the teaching of the prior art which in part takes into consideration the existing danger for operating personnel during handling of radioactive waste solutions when the goal is set to create a method with which a mechanical stirring of the mixtures can be avoided. For this reason, the prior art also suggested a hydraulic binding means which hardens also under water for his method but, however, left unconsidered that as set forth in greater detail below, the use of cement with acid solutions as a consequence of the uncontrollable heating and bubbling of the mixture cannot lead to a solid end product. The endangering of operating personnel accordingly is to be disregarded. The prior art additionally disregards that The cement suggested by him as the binding means requires a hardening time of several days. This has as a consequence that a sealing of the product is not immediately possible and for example an emission of volatile nuclids cannot be precluded over a longer time period.

For the foregoing reasons there is unmistakably clear that the expert cannot obtain any showing or suggestion from the prior art as to the teaching of the present invention because the disclosures of the prior art are not concerned at all with the object that is the basis of the present invention and the stated binding means accordingly have been selected under complete different viewpoints.

With respect to the technical advance attained by way of the present invention there can be stated the following:

With the solidification of product produced from acid solutions, tests were made as to the pressure stability or strength thereof. The square formed piece was cut out of a product produced at a particular time and the following results were obtained:

Upon applying the method covered primarily by the present invention involving the gypsum-pumice mixture, there was added a 24% solution $HNO_3$ for the test body with which a breakage or crushing of the test body occurred at a maximum load of 408 Kp (Kilopont). For a test body in which a 38% solution $HNO_3$ was solidified, there was obtained 50.4 Kp as the maximum load. This results in a pressure strength or stability of 18.7 $Kp/cm^2$ respectively 2.67 $Kp/cm^2$ (quotient of the maximum load bringing about the breakage and the original cross section of the test body).

In comparison hereto, a 24% $HNO_3$ solution was consolidated in a known manner in a mixture of 2 volume portions cement and one volume portion vermiculite. Already an attempt to cut out a test body from the resulting product for the pressure measurement failed however, since a porous and easily destructible product had formed as a consequence of bubbles resulting during the consolidation. Accordingly, the maximum load necessary to crush such a test body would be estimated at $<0.1$ Kp, which corresponds to a pressure-strength value of $<0.1$ $Kp/cm^2$.

For determining the emission of transient or fleeting radioactive materials during the procedure of consolidation, air was suctioned or withdrawn at a time above the mixture admixed for consolidation and accordingly the suctioned-off activity was ascertained therewith. A 32% $HNO_3$ solution displaced with Tritinm water (MTO) was admixed once with a gypsum-pumice mixture and another time was admixed with a mixture consisting of cement/vermiculite. During the consolidation procedure, the temperature in the gypsum-pumice mixture amounted to 24 C.° while amounting to 105 C.° in the mixture consisting of cement and vermiculite. The emission rate determined for the gypsum-pumice mixture amounted accordingly to far less than one-third the emission rate determined for the cement-vermiculite mixture.

Additionally, in a series of further investigations, there were determined the emission rates with a gypsum-pumice mixture in comparison to a gypsum-waterthe method is independent of the pH of the solution, the method comprising the steps of:

mixing gypsum having a water of crystillization content in the range of 4.7% to 6.6% and a carbonate content of less than 1.0% with water glass having a specific weight in about a range of 1.2 to 1.8 $Kg/dm^3$, the ratio of gypsum to water glass being about 1 Kg of gypsum to about 100 ml to 500 ml of water glass to form a stable binder with an extended shelf life, and subequently adding the aqueous solution to the binder at a ratio of binder to aqueous solution of about 1 kg to 500 ml.

* * * * *